US008524375B2

(12) United States Patent
Jarosinski

(10) Patent No.: US 8,524,375 B2
(45) **Date of Patent: *Sep. 3, 2013**

(54) THERMAL SPRAY COATED WORK ROLLS FOR USE IN METAL AND METAL ALLOY SHEET MANUFACTURE

(75) Inventor: William John Crim Jarosinski, Carmel, IN (US)

(73) Assignee: Praxair S.T. Technology, Inc., North Haven, CT (US)

( * ) Notice: Subject to any disclaimer, the term of this patent is extended or adjusted under 35 U.S.C. 154(b) by 856 days.

This patent is subject to a terminal disclaimer.

(21) Appl. No.: 11/787,412

(22) Filed: Apr. 16, 2007

(65) Prior Publication Data

US 2007/0261767 A1 Nov. 15, 2007

Related U.S. Application Data

(60) Provisional application No. 60/799,656, filed on May 12, 2006.

(51) Int. Cl.

| | |
|---|---|
| ***B32B 15/16*** | (2006.01) |
| ***C22C 29/06*** | (2006.01) |
| *B05D 1/12* | (2006.01) |

(52) U.S. Cl.

USPC ..... 428/558; 428/550; 428/551; 428/553; 428/564

(58) Field of Classification Search

None

See application file for complete search history.

(56) References Cited

U.S. PATENT DOCUMENTS

| | | | | |
|---|---|---|---|---|
| 2,714,563 | A | 8/1955 | Poorman et al. | |
| 4,519,840 | A | 5/1985 | Jackson et al. | |
| 4,626,476 | A * | 12/1986 | Londry et al. | 428/457 |
| 4,626,477 | A | 12/1986 | Jackson et al. | |
| 5,784,776 | A | 7/1998 | Saito et al. | |
| 6,138,490 | A | 10/2000 | Shannon | |
| 6,153,326 | A | 11/2000 | Shannon | |
| 6,503,290 | B1 | 1/2003 | Jarosinski et al. | |
| 2002/0119343 | A1 * | 8/2002 | Betts | 428/651 |

(Continued)

FOREIGN PATENT DOCUMENTS

| | | | |
|---|---|---|---|
| EP | 0687746 | A1 * | 12/1995 |
| JP | 05195178 | A * | 8/1993 |
| WO | WO 2005068099 | A1 * | 7/2005 |

OTHER PUBLICATIONS

Roisum, D., Critical Thinking When Should Crowned Rollers be Used? www.componex.net No Date.*

(Continued)

*Primary Examiner* — David Sample
*Assistant Examiner* — Adam Krupicka
(74) *Attorney, Agent, or Firm* — Nilay S. Dalal; Robert J. Hampsch

(57) ABSTRACT

This invention relates to thermally spray coated work rolls for use in metal or metal alloy, e.g., aluminum alloy, sheet manufacture comprising a cylindrical-like structure having an outer peripheral surface and a thermally sprayed coating on the outer peripheral surface of said cylindrical-like structure, said thermally sprayed coating comprising from about 65 to about 95 weight percent of one or more Group VI metal carbides, and from about 5 to about 35 weight percent of one or more transition metals selected from chromium, manganese, iron, cobalt and nickel. This invention also relates to a process for preparing the work rolls for use in metal or metal alloy, e.g., aluminum alloy, sheet manufacture, a method for manufacturing metal or metal alloy, e.g., aluminum alloy, sheet using the thermally spray coated work rolls, and a thermal spray powder for coating the outer peripheral surface of the work rolls for use in metal or metal alloy, e.g., aluminum alloy, sheet manufacture.

37 Claims, 2 Drawing Sheets

(56) References Cited

U.S. PATENT DOCUMENTS

| | | | | |
|---|---|---|---|---|
| 2004/0104378 | A1* | 6/2004 | Bhatia | 252/389.54 |
| 2005/0051975 | A1 | 3/2005 | Takayama et al. | |

OTHER PUBLICATIONS

Wirojanupatump et al., The influence of HOVF powder feedstock charachteristics on the abrasive wear behaviour of CrxCy-NiCr coatings, 2001, Elsevier, Wear, 249(2001), pp. 829-837.*

English machinne translation of EP 0 687 746 A1, translated Jul. 20, 2012.*

English machinne translation of JP 05-195178, translated Jul. 22, 2012.*

Nature of Thermal Spray Coatings, Internet Archive of http://www.gordonengland.co.uk/tsc.htm archived Feb. 22, 2001.*

* cited by examiner

THERMAL SPRAY COATED WORK ROLLS FOR USE IN METAL AND METAL ALLOY SHEET MANUFACTURE

RELATED APPLICATIONS

This application claims the benefit of U.S. Provisional Application Ser. No. 60/799,656, filed on May 12, 2006, which is incorporated herein by reference.

FIELD OF THE INVENTION

This invention relates to thermally spray coated work rolls for use in metal and metal alloy, e.g., aluminum alloy, sheet manufacture, a process for preparing work rolls for use in metal and metal alloy, e.g., aluminum alloy, sheet manufacture, a method for manufacturing metal and metal alloy, e.g., aluminum alloy, sheet using thermally spray coated work rolls, and a thermal spray powder for coating the outer peripheral surface of work rolls for use in metal and metal alloy, e.g., aluminum alloy, sheet manufacture.

BACKGROUND OF THE INVENTION

Work rolls play an important role in the manufacture of metal and metal alloy sheet. For example, the aluminum industry places a high value on running aluminum alloy sheet lines in a continuous manner. Significant losses (energy, capacity, productivity, product damage, etc.) are associated with down time in aluminum alloy sheet production. High line speeds and forces, exerted by work rolls to reduce sheet gauge and improve sheet quality, cause significant wear of the work roll surface. Aluminum alloy sheets are used to form containers, such as can stock, vehicle components, corrosion resistant building materials, foil, and the like.

In a typical aluminum alloy sheet process, a slab can be cast and annealed (homogenized), and then, the aluminum alloy can be hot and cold rolled (reduction) to provide an intermediate gauge sheet. The slab and sheet temperatures and other operating controls can be critical in these steps. Thereafter, the aluminum alloy sheet can be passed through work rolls to adjust the thickness (final gauge) and improve the sheet surface finish.

In general, the work rolls that come in contact with aluminum alloy sheet desirably satisfy the following conditions: the rolls are wear resistant (extend the time between maintenance shut-downs); the rolls impart minimal surface damage to the aluminum alloy sheet; the rolls resist corrosion caused by different types of lubricant; and the life cycle cost of the rolls is low.

Common work rolls are fabricated from iron base alloys and have limited life caused by wear from high speed lines and high forces exerted by the rolling process. A roll is removed from service once its surface degrades and the roll negatively impacts the quality of the sheet. Examples of potential quality issues include banding, debris, vibration, surface defects (pits), increased surface roughness, and the like. Iron-based rolls can be chromium plated at an additional cost, but the roll life extension is limited.

There continues to be a need in the art for work rolls that can be used for extended periods of time without damaging the surface quality of the metal or metal alloy sheet. There also continues to be a need for work rolls that have improved resistance to wear and corrosion.

SUMMARY OF THE INVENTION

This invention relates in part to work roll for use in metal or metal alloy, e.g., aluminum alloy, sheet manufacture comprising a cylindrical-like structure having an outer peripheral surface and a thermally sprayed coating on the outer peripheral surface of said cylindrical-like structure, said thermally sprayed coating comprising from about 65 to about 95 weight percent of one or more Group VI metal carbides, and from about 5 to about 35 weight percent of one or more transition metals selected from chromium, manganese, iron, cobalt and nickel.

This invention also relates in part to a process for preparing a work roll for use in metal or metal alloy, e.g., aluminum alloy, sheet manufacture comprising (i) providing a cylindrical-like structure having an outer peripheral surface, and (ii) thermally spraying a coating onto the outer peripheral surface of said cylindrical-like structure, said thermally sprayed coating comprising from about 65 to about 95 weight percent of one or more Group VI metal carbides, and from about 5 to about 35 weight percent of one or more transition metals selected from chromium, manganese, iron, cobalt and nickel.

This invention further relates in part to a method for manufacturing metal or metal alloy, e.g., aluminum alloy, sheet comprising (i) casting and optionally annealing a metal or metal alloy slab, (ii) rolling the metal or metal alloy slab to provide an intermediate gauge metal or metal alloy sheet, and (iii) passing the intermediate gauge metal or metal alloy sheet through one or more work rolls to provide a final gauge metal or metal alloy sheet, said one or more work rolls comprising a cylindrical-like structure having an outer peripheral surface and a thermally sprayed coating on the outer peripheral surface of said cylindrical-like structure, said thermally sprayed coating comprising from about 65 to about 95 weight percent of one or more Group VI metal carbides, and from about 5 to about 35 weight percent of one or more transition metals selected from chromium, manganese, iron, cobalt and nickel.

This invention yet further relates in part to a thermal spray powder for coating the outer peripheral surface of a work roll for use in metal or metal alloy, e.g., aluminum alloy, sheet manufacture comprising from about 65 to about 95 weight percent of one or more Group VI metal carbides, and from about 5 to about 35 weight percent of one or more transition metals selected from chromium, manganese, iron, cobalt and nickel.

DETAILED DESCRIPTION OF THE INVENTION

Figure 1:
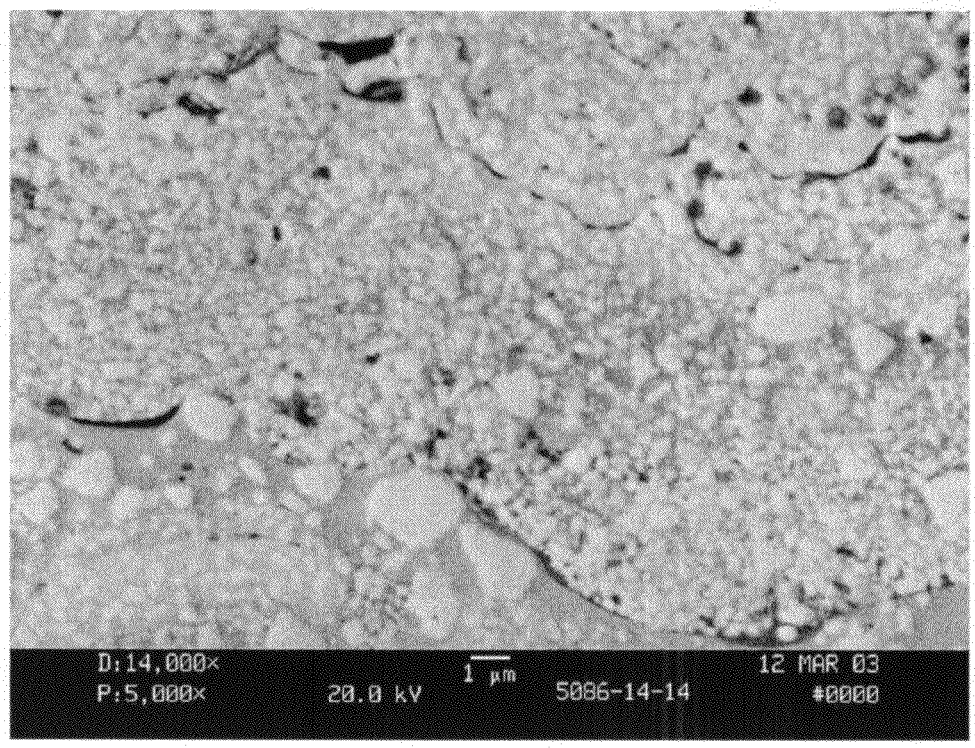
FIG. 1 is a photomicrograph showing the microstructure of a coating of this invention at 5000× magnification.

As indicated above, this invention relates in part to a thermal spray powder for coating the outer peripheral surface of a work roll for use in metal or metal alloy, e.g., aluminum alloy, sheet manufacture comprising from about 65 to about 95 weight percent of one or more Group VI metal carbides, and from about 5 to about 35 weight percent of one or more transition metals selected from chromium, manganese, iron, cobalt and nickel. Preferably, this invention relates in part to a thermal spray powder for coating the outer peripheral surface of a work roll for use in aluminum alloy sheet manufacture comprising from about 76 to about 86 weight percent of tungsten, from about 3 to about 5.5 weight percent of carbon, from about 7 to about 13 weight percent of cobalt, and from about 2.5 to about 7 weight percent of chromium.

Thermal spraying powders are provided that are capable of achieving thermal sprayed coatings having desired wear and corrosion resistance, especially for work rolls used in processes for rolling metal alloy, e.g., aluminum alloy, sheet. Also, methods of forming thermal sprayed coatings on the work rolls are provided using such thermal spraying powders.

Illustrative Group VI metal carbides can be represented by the formula $M_xC$ where M represents one or more of Cr, Co, Mo and W and x is an integer of from 1 to 12. The $M_xC$ phases can consist of MC, $M_2C$, $M_6C$, MgC and $M_{12}C$. Suitable Group VI metal carbides useful in this invention include, for example, WC, MoC, CrC, WCrC, WMoC, CrMoC, and the like. Suitable mixtures of Group VI metal carbides useful in this invention include, for example, WC and WCrC, WC and CrC, and the like. Illustrative transition metals useful as metallic binders include one or more of Cr, Mn, Fe, Co and Ni. Suitable mixtures of transition metals useful in this invention include, for example, Cr and Co, Cr and Mo, and the like.

The content of one or more Group VI metal carbides in the thermal spraying powder can range from about 65 to about 95 weight percent, and preferably from about 70 to about 90 weight percent. If the content of the one or more Group VI metal carbides is too low, the wear resistance of the thermal sprayed coating may decrease. If the content of the one or more Group VI metal carbides is too high, the toughness and adhesion of the thermal sprayed coating may decrease. With regard to chromium, it is understood that chromium can be present as a transition metal as well as a Group VI metal carbide.

The metallic binder content of the one or more transition metals in the thermal spraying powder can range from about 5 to about 35 weight percent, and preferably from about 10 to about 30 weight percent. If the content of the one or more transition metals is too low, the toughness and adhesion of the thermal sprayed coating may decrease or the wear and oxidation resistance of the thermal sprayed coating may decrease. If the content of the one or more transition metals in the binder phase is too high, the wear resistance of the thermal sprayed coating may decrease or the toughness and adhesion of the thermal sprayed coating may decrease. With regard to chromium, it is understood that chromium can be present as a Group VI metal carbide as well as a transition metal.

As indicated above, a preferred thermal spraying powder of this invention comprises WCCoCr. Such powders can be useful in the manufacture of thermal spray coatings for work rolls used in processes for rolling metal alloy, e.g., aluminum alloy. Elemental concentrations in the preferred powders can vary but should be within the ranges set forth below.

The content of tungsten in the thermal spraying powder can range from about 76 to about 86 weight percent, and preferably from about 78 to about 84 weight percent. If the content of tungsten is too low, the wear resistance of the thermal sprayed coating may decrease. If the content of tungsten is too high, the toughness and adhesion of the thermal sprayed coating may decrease.

The content of carbon in the thermal spraying powder can range from about 3 to about 5.5 weight percent, and preferably from about 3.5 to about 5.2 weight percent. If the content of carbon is too low, the wear resistance of the thermal sprayed coating may decrease. If the content of carbon is too high, the toughness and adhesion of the thermal sprayed coating may decrease.

The content of cobalt in the thermal spraying powder can range from about 7 to about 13 weight percent, and preferably from about 7 to about 11 weight percent. If the content of cobalt is too low, the toughness and adhesion of the thermal sprayed coating may decrease. If the content of cobalt is too high, the wear resistance of the thermal sprayed coating may decrease.

The content of chromium in the thermal spraying powder is from about 2.5 to about 7 weight percent, and preferably from about 3 to about 6 weight percent. If the content of chromium is too low, the wear and oxidation resistance of the thermal sprayed coating may decrease. If the content of chromium is too high, the toughness and adhesion of the thermal sprayed coating may decrease.

The addition of chromium is an important modification of the preferred composition, because chromium forms a tenacious oxide layer in the coating that acts as a barrier to corrosion. Chromium can be found in the thermal sprayed coating in many forms; as an oxide in the coating splat boundaries, as metallic alloy of cobalt in the coating binder phase, and potentially as a wear resistant complex carbide. The chromium phases improve the coating's corrosion resistance and reduce the potential for galvanic interaction within the coating and between the coating and roll base.

The total content of Group VI metal carbide and metallic binder, e.g., tungsten, carbon, cobalt and chromium, in the thermal spraying powder should be no less than 97%. In the case where a thermal sprayed powder contains components other than Group VI metal carbide and transition metals, the content of those other components in the thermal spraying powder is less than 3% by weight.

The average particle size of the thermal spraying powders useful in this invention is preferably set according to the type of thermal spray device and thermal spraying conditions used during thermal spraying. The particle size can range from about from about 5 to about 50 microns, and preferably from about 10 to about 45 microns.

The average Group VI metal carbide grain size within the thermal spraying powder useful in this invention is preferably set according to the type of thermal spray device and thermal spraying conditions used during thermal spraying. The Group VI metal carbide grain size can range from about 0.2 to about 5 microns, and preferably from about 0.3 to about 2 microns.

This invention further relates to starting with fine Group VI metal carbide grains within the thermal spray powder which fosters the formation of complex phases and effectively reduces the amount of metallic binder that is available for attack by corrosive media. During the thermal spray process, some Group VI metal carbide grains can partially dissolve and alloy with the metallic binder phase. If the Group VI metal carbide grains are too fine, too many may dissolve or decarburize causing the wear resistance of the thermal spray coating to be compromised.

The thermal spraying powders useful in this invention can be produced by conventional methods such as agglomeration (spray dry and sinter or sinter and crush methods) or cast and crush. In a spray dry and sinter method, a slurry is first prepared by mixing a plurality of raw material powders and a suitable dispersion medium. This slurry is then granulated by spray drying, and a coherent powder particle is then formed by sintering the granulated powder. The thermal spraying powder is then obtained by sieving and classifying (if agglomerates are too large, they can be reduced in size by crushing). The sintering temperature during sintering of the granulated powder is preferably 1000 to 1300° C.

The thermal spraying powders according to this invention may be produced by another agglomeration technique, sinter and crush method. In the sinter and crush method, a compact is first formed by mixing a plurality of raw material powders followed by compression and then sintered at a temperature between 1200 to 1400° C. The thermal spraying powder is then obtained by crushing and classifying the resulting sintered compact into the appropriate particle size distribution.

The thermal spraying powders according to this invention may also be produced by a cast (melt) and crush method instead of agglomeration. In the melt and crush method, an ingot is first formed by mixing a plurality of raw material powders followed by rapid heating, casting and then cooling. The thermal spraying powder is then obtained by crushing and classifying the resulting ingot.

In general, the thermal spraying powders can be produced by conventional processes such as the following:

a. Spray Dry and Sinter method—for example, WC, Co and Cr are mixed into a slurry and then spray granulated. The agglomerated powder is then sintered at a high temperature (at least 1000° C.) and sieved to a suitable particle size distribution for spraying;

b. Sinter and Crush method—for example, WC, Co and Cr are sintered at a high temperature in a hydrogen gas or inert atmosphere (having a low partial pressure of oxygen) and then mechanically crushed and sieved to a suitable particle size distribution for spraying;

c. Cast and Crush method—for example, WC, W, Co and Cr are fused in a crucible (a graphite crucible can be used to add C) and then the resulting casting is mechanically crushed and sieved;

Coated particle method—for example, the surfaces of WC particles are subjected to Co and Cr plating; and Densification method—the powder produced in any one of above process (i)-(iv) is heated by plasma flame or laser and sieved (plasma-densifying or laser-densifying process).

The average particle size of each raw material powder is preferably no less than 0.1 microns and more preferably no less than 0.2 microns, but preferably no more than 10 microns. If the average particle size of a raw material powder is too small, costs may increase. If the average particle size of a raw material powder is too large, it may become difficult to uniformly disperse the raw material powder.

The individual particles that compose the thermal spraying powder preferably have enough mechanical strength to stay coherent during the thermal spraying process. If the mechanical strength is too small, the powder particle may break apart clogging the nozzle or accumulate on the inside walls of the thermal spray device.

The coating process involves flowing powder through a thermal spraying device that heats and accelerates the powder onto a roll base (substrate). Upon impact, the heated particle deforms resulting in a thermal sprayed lamella or splat. Overlapping splats make up the coating structure. A detonation process useful in this invention is disclosed in U.S. Pat. No. 2,714,563, the disclosure of which is incorporated herein by reference. The detonation process is further disclosed in U.S. Pat. Nos. 4,519,840 and 4,626,476, the disclosures of which are incorporated herein by reference, which include coatings containing tungsten, carbide, cobalt and chromium compositions. U.S. Pat. No. 6,503,290, the disclosure of which is incorporated herein by reference, discloses a high velocity oxygen fuel process useful in this invention to coat compositions containing W, C, Co, and Cr.

As also indicated above, this invention relates in part to a process for preparing a work roll for use in metal or metal alloy, e.g., aluminum alloy, sheet manufacture comprising (i) providing a cylindrical-like structure having an outer peripheral surface, and (ii) thermally spraying a coating onto the outer peripheral surface of said cylindrical-like structure, said thermally sprayed coating comprising from about 65 to about 95 weight percent of one or more Group VI metal carbides, and from about 5 to about 35 weight percent of one or more transition metals selected from chromium, manganese, iron, cobalt and nickel. Preferably, this invention relates in part to a process for preparing a work roll for use in aluminum alloy sheet manufacture comprising (i) providing a cylindrical-like structure having an outer peripheral surface, and (ii) thermally spraying a coating onto the outer peripheral surface of said cylindrical-like structure, said thermally sprayed coating comprising from about 76 to about 86 weight percent of tungsten, from about 3 to about 5.5 weight percent of carbon, from about 7 to about 13 weight percent of cobalt, and from about 2.5 to about 7 weight percent of chromium.

In the coating formation step, the thermal spraying powder is thermally sprayed onto the surface of a roll, and as a result, a thermal sprayed coating is formed on the surface of the roll. High-velocity-oxygen-fuel or detonation gun spraying are the preferable methods of thermally spraying the thermal spraying powder. Other coating formation processes include plasma spraying, plasma transfer arc (PTA), flame spraying, or laser cladding.

In a preferred embodiment of this process, a sealing treatment agent is coated onto the thermal sprayed coating formed on the surface of the substrate in the aforementioned coating formation step. Illustrative sealing treatments include, for example, two-part epoxies (epoxy resin plus epoxy hardener). The sealing treatment agent is applied by, for example, dipping, brush coating, or spraying.

The sealing treatment agent can easily penetrate into small holes or gaps in the micrometer range because of its low surface tension and viscosity. To enhance penetration of the sealant into the pores on the surface of the roll, a suitable wetting agent can be added. Illustrative wetting agents include, for example, toluene, acetone, xylene and alcohols.

According to this invention, work rolls intended for use in contact with a metal or metal alloy, e.g., aluminum alloy, sheet are first thermal spray coated with a protective layer of a Group VI metal carbide transition metal, e.g., tungsten carbide cobalt chromium. The sealant can then be deposited over the coating to prevent penetration of corrosive media to the substrate of the roll and also to minimize buildup of debris or oxides on the surface of the coated roll.

In an embodiment of the invention, the unfinished spray-coated layer has a thickness of about 0.025 to about 1.0 millimeters and a porosity of not more than about 2.5%. The unfinished spray-coated layer has a preferable thickness of about 0.025 to about 0.5 millimeters and a porosity of not more than about 1.5%. If the coating is too thick, stresses could lead to premature cracking and coating spallation from the reduction forces. The thermal sprayed coating formed by the thermal sprayed coating forming process according to this invention may have desired wear resistance (e.g. surface profile and surface roughness retention) and corrosion resistance.

The work rolls of this invention exhibit desirable surface roughness that is resistant to degradation, rapid increase in surface roughness, and minimizes surface defects such as sheet marking and white blemishes, oxide formation. The work rolls of this invention have a surface roughness less than about 60 microinches Ra, preferably less than about 40 microinches Ra, and more preferably less than or equal to 30 microinches Ra.

In an embodiment of this invention, a thermal spray coating is applied to the surface of a work roll used for rolling and finishing a metal or metal alloy, e.g., aluminum alloy, sheet, wherein the coated work roll has an excellent resistance to wear and corrosion. The coated work roll is effective for the manufacture of metal or metal alloy, e.g., aluminum alloy, sheet with excellent quality and high productivity. Group VI metal carbide transition metal, e.g., tungsten carbide cobalt chromium, material applied by detonation or high velocity oxygen fuel processes can provide increased equipment life in metal and metal alloy, e.g., aluminum alloy, sheet rolling and finishing lines.

The coated work rolls of this invention can exhibit resistance to wear and corrosion yielding longer life for thermal spray coated work rolls. An important aspect of the thermally sprayed coating is the surface finish. The coated surface can be machined or ground with cutting tools or hard media to obtain or retain a particular roll profile (e.g., a crown shape in which the work roll surface is elevated towards the middle portion of the work roll and less elevated towards the end portions of the work roll). The machined and/or ground surface can be finished with flexible belts (diamond or cubic boron nitride media) to obtain a particular surface roughness to minimize surface defects in the sheet product. A sealer coating can be applied for resistance to corrosive media and/or lubricating compounds. In a preferred embodiment, the thermally sprayed coating surface is finished sufficient to minimize or eliminate marking or defect on metal or metal alloy sheet manufactured using the work roll.

In an embodiment of the invention, the finished spray-coated layer has a thickness of about 0.025 to about 0.25 millimeters and a porosity of not more than about 2.5%. The finished spray-coated layer has a preferable thickness of about 0.025 to about 0.1 millimeters and a porosity of not more than about 1.5%. If the coating is too thick, stresses could lead to premature cracking and coating spallation from the reduction forces. The thermal sprayed coating formed by the thermal sprayed coating forming process according to this invention may have desired wear resistance (e.g., surface profile and surface roughness retention) and corrosion resistance.

As indicated above, this invention relates in part to work roll for use in metal or metal alloy, e.g., aluminum alloy, sheet manufacture comprising a cylindrical-like structure having an outer peripheral surface and a thermally sprayed coating on the outer peripheral surface of said cylindrical-like structure, said thermally sprayed coating comprising from about 65 to about 95 weight percent of one or more Group VI metal carbides, and from about 5 to about 35 weight percent of one or more transition metals selected from chromium, manganese, iron, cobalt and nickel. Preferably, this invention relates in part to a work roll for use in aluminum alloy sheet manufacture comprising a cylindrical-like structure having an outer peripheral surface and a thermally sprayed coating on the outer peripheral surface of said cylindrical-like structure, said thermally sprayed coating comprising from about 76 to about 86 weight percent of tungsten, from about 3 to about 5.5 weight percent of carbon, from about 7 to about 13 weight percent of cobalt, and from about 2.5 to about 7 weight percent of chromium.

The work rolls of this invention for use in metal or metal alloy, e.g., aluminum alloy, sheet manufacture can vary in shape and size. The work rolls typically have a cylindrical-like structure with an outer peripheral surface and a hollow or solid core. In an embodiment, the coated surface on the work rolls can be machined or ground with cutting tools or hard media to obtain or retain a particular roll profile (e.g., a crown shape in which the work roll surface is elevated towards the middle portion of the work roll and less elevated towards the end portions of the work roll). The size of the work rolls can range from about 900 millimeters or less to about 3050 millimeters or greater in length and from about 150 millimeters or less to about 460 millimeters or greater in diameter. The shape and size of the work rolls of this invention are not narrowly critical and need only be of sufficient size and shape to be useful in metal or metal alloy sheet manufacture.

A typical process for manufacturing aluminum alloy sheet involves casting an aluminum alloy slab (the process can be continuous or batch and optionally include an annealing step), rolling the aluminum alloy slab to provide an intermediate gauge aluminum alloy sheet, and passing the intermediate gauge aluminum alloy sheet through a system of work rolls to provide a final gauge aluminum alloy sheet.

As indicated above, this invention relates in part to a method for manufacturing metal or metal alloy, e.g., aluminum alloy, sheet comprising (i) casting and optionally annealing a metal or metal alloy slab, (ii) rolling the metal or metal alloy slab to provide an intermediate gauge metal or metal alloy sheet, and (iii) passing the intermediate gauge metal or metal alloy sheet through one or more work rolls to provide a final gauge metal or metal alloy sheet, said one or more work rolls comprising a cylindrical-like structure having an outer peripheral surface and a thermally sprayed coating on the outer peripheral surface of said cylindrical-like structure, said thermally sprayed coating comprising from about 65 to about 95 weight percent of one or more Group VI metal carbides, and from about 5 to about 35 weight percent of one or more transition metals selected from chromium, manganese, iron, cobalt and nickel.

Preferably, this invention relates in part to a method for manufacturing aluminum alloy sheet comprising (i) casting and optionally annealing an aluminum alloy slab, (ii) rolling the aluminum alloy slab to provide an intermediate gauge aluminum alloy sheet, and (iii) passing the intermediate gauge aluminum alloy sheet through one or more work rolls to provide a final gauge aluminum alloy sheet, said one or more work rolls comprising a cylindrical-like structure having an outer peripheral surface and a thermally sprayed coating on the outer peripheral surface of said cylindrical-like structure, said thermally sprayed coating comprising from about 76 to about 86 weight percent of tungsten, from about 3 to about 5.5 weight percent of carbon, from about 7 to about 13 weight percent of cobalt, and from about 2.5 to about 7 weight percent of chromium.

In the thermal spray coated layer formed on the roll used for reduction, the thickness of the finished coating layer is an important factor. When the coated rolls are pressed together (pressure is typically applied by back-up rolls), large stresses form within the coated layer and the roll substrate. Finished thermal spray coated layers greater than about 0.25 millimeters may be too thick to resist damage to the coating from rolling.

According to this invention with respect to Group VI metal carbides with metallic binder composed of one or more of Cr, Mn, Fe, Co and Ni), the thermal sprayed layer can consist of metal carbides, $M_xC$ (where M represents metal and is one or more of Cr, Co, Mo and W); metallic binder consisting of Cr, Mn, Fe, Co and/or Ni; and a protective $Cr_2O_3$ layer that can protect the carbides, binder, and resultant particle splat boundaries. The $M_xC$ phases can consist of MC, $M_2C$, $M_6C$, $M_9C$ and $M_{12}C$.

For the WCCoCr thermal spray layer embodiment of this invention, the predominate carbide phases are WC, major, and $W_2C$, minor. Complex carbide phases are difficult to observe, but could be present in small amounts especially in the regions where the major or minor carbide phase has been dissolved into the metal matrix. Carbides that precipitate out of solution can contain Co and Cr. This thermal sprayed layer is formed on a surface of a work roll used in the manufacture of a metal or metal alloy, e.g., aluminum alloy, sheet. According to this invention, this spray coated layer can exhibit wear resistance and corrosion resistance during the cold rolling process. By using such a thermal spray coated layer, there can be provided high productivity and good quality in the metal or metal alloy, e.g., aluminum alloy, sheet product.

The thermally sprayed coatings of this invention can provide more wear resistance than chromium plated steel rolls. Although thermal spray coated rolls may have a higher cost than chromium plated steel rolls, value is gained by extending the roll life and reducing losses (energy, capacity, product damage, etc.).

The following examples are provided to further describe the invention. The examples are intended to be illustrative in nature and are not to be construed as limiting the scope of the invention.

EXAMPLES

Figure 2:
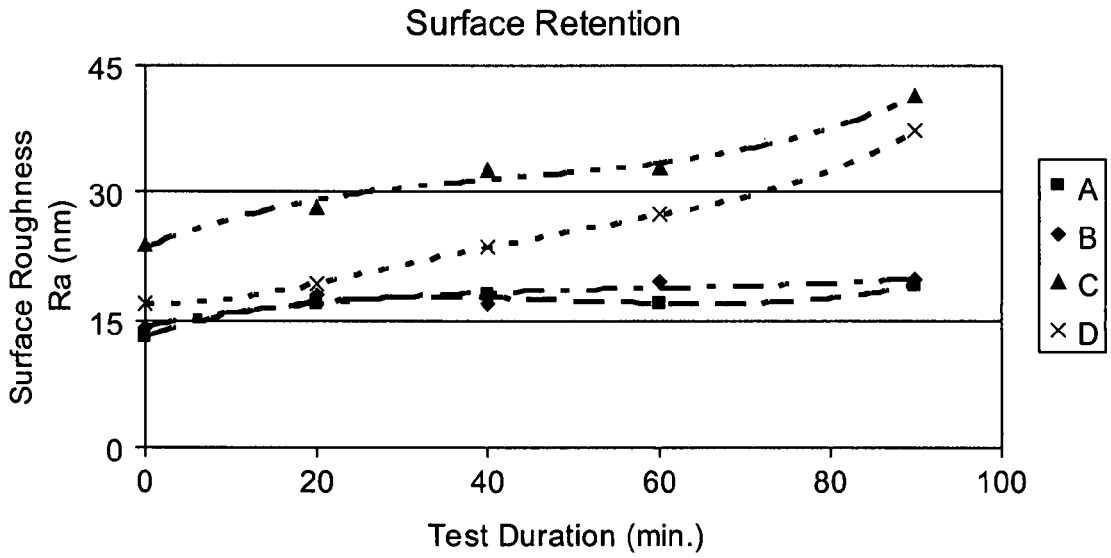
FIG. 2 is a graph showing, at set time intervals, the surface roughness of compositions A, B, C and D from the examples below that were measured and compared to determine surface retention.

The examples listed in Table I below are thermal sprayed coatings applied to steel substrates. Table I shows composition (weight percent), thermal spray process, powder manufacture method (including starting tungsten carbide size), qualitative performance based on surface retention data shown in FIG. 2, and additional comments.

TABLE I

| Composition | Process | Powder | Performance | Comments |
|---|---|---|---|---|
| A.) 81W, 10Co, 4Cr, 5C | HVOF | Agglomeration & sinter, 0.5-1 μm carbides | Excellent | Very little increase in surface roughness, Ra |
| B.) 81W, 8Co, 6Cr, 5C | HVOF | Agglomeration & sinter, 0.5-1 μm carbides | Excellent | Very little increase in surface roughness, Ra |
| C.) 82W, 10Co, 4Cr, 4C | Detonation | Sinter & crush, 2-5 μm carbides | Good | Slight increase in surface roughness, Ra |
| D.) 67W, 20Cr, 7Ni, 6C | Detonation | Sinter & crush, 2-5 μm carbides | Good | Slight increase in surface roughness, Ra |

The test method involves placing a polished coating surface with a starting surface roughness (at t=0) into a vibratory finisher, Buehler Vibromet I. The samples were abraded under identical loads with 1-2 μm particles of titanium dioxide (in dry conditions). At set time intervals (shown in FIG. 2), the surface roughness of the samples was measured and compared to determine surface retention.

For compositions A and B above, the WCCoCr applied by high velocity oxygen fuel (HVOF JP-5000) exhibited excellent surface retention. Compositions C and D exhibited good surface retention. All of these carbide containing coatings may offer improved wear resistance for work rolls, and better surface retention should correlate with better metal sheet quality in the rolling and finishing manufacturing line. Thermally spray coated work rolls should benefit from the increased wear resistance of carbide coatings and stay in service longer because of good sheet quality.

While there has been shown and described what are considered to be preferred embodiments of the invention, it will, of course, be understood that various modifications and changes in form or detail could readily be made without departing from the spirit and scope of the invention. It is, therefore, intended that the invention be not limited to the exact form and detail herein shown and described, nor to anything less than the whole of the invention herein disclosed as hereinafter claimed.

The invention claimed is:

1. A work roll for use in metal or metal alloy sheet manufacture comprising a cylindrical-like structure having an outer peripheral surface and a thermally sprayed coating on the outer peripheral surface of said cylindrical-like structure, wherein said thermally sprayed coating is thermal sprayed from a thermal spray powder, said thermally sprayed coating comprising from about 65 to about 95 weight percent of one or more metal carbides represented by the formula $M_xC$ wherein M is one or more of W, Co, Mo and Cr, and from about 5 to about 35 weight percent of one or more transition metals selected from chromium, manganese, iron, cobalt and nickel; wherein said thermal spray powder has a particle size from about 5 to about 50 microns and a Group VI metal carbide grain size of from about 0.1 to about 2 microns; and wherein said thermally sprayed coating has a surface roughness less than about 60 microinches Ra; wherein $M_xC$ comprises one or more of MC, $M_2C$, $M_6C$, $M_9C$ and $M_{12}C$ phases; and wherein said thermally sprayed coating has a porosity of not greater than about 2.5%.

2. The work roll of claim 1 wherein the metal or metal alloy sheet comprises aluminum or aluminum alloy, iron or iron alloy, copper or copper alloy, titanium or titanium alloy, or nickel or nickel alloy.

3. The work roll of claim 2 wherein the iron or iron alloy comprises steel or stainless steel.

4. The work roll of claim 1 wherein the one or more Group VI metal carbides are selected from WC, MoC, CrC, WCrC, WMoC and CrMoC.

5. The work roll of claim 1 wherein the thermally sprayed coating comprises from about 70 to about 90 weight percent of said one or more Group VI metal carbides and from about 10 to about 30 weight percent of said one or more transition metals.

6. The work roll of claim 1 wherein the thermally sprayed coating comprises from about 76 to about 86 weight percent of tungsten, from about 3 to about 5.5 weight percent of carbon, from about 7 to about 13 weight percent of cobalt, and from about 2.5 to about 7 weight percent of chromium.

7. The work roll of claim 1 wherein the thermally sprayed coating comprises from about 78 to about 84 weight percent of tungsten, from about 3.5 to about 5.2 weight percent of carbon, from about 7 to about 11 weight percent of cobalt, and from about 3 to about 6 weight percent of chromium.

8. The work roll of claim 1 wherein a sealant is applied to the thermally sprayed coating.

9. The work roll of claim 8 wherein the sealant comprises an epoxy resin plus epoxy hardener.

10. The work roll of claim 1 wherein the thermally sprayed coating has a thickness of from about 0.025 to about 1.0 millimeters.

11. The work roll of claim 1 wherein said thermally sprayed coating is formed by a plasma coating method, a high-velocity oxygen fuel coating method or a detonation coating method.

12. The work roll of claim 1 for use in aluminum alloy sheet manufacture.

13. The work roll of claim 1 wherein the thermally sprayed coating surface is machined and/or ground.

14. The work roll of claim 1 wherein the thermally sprayed coating surface is machined and/or ground sufficient to obtain or retain a work roll profile having a crown shape.

15. The work roll of claim 1 wherein the thermally sprayed coating surface is finished sufficient to minimize or eliminate marking or defect on metal or metal alloy sheet manufactured using said work roll.

16. The work roll of claim 15 wherein the finished thermally sprayed coating has a thickness of from about 0.025 to about 0.25 millimeters.

17. The work roll of claim 1 wherein said thermal spray powder has a Group VI metal carbide grain size of from about 0.5 to about 1 micron.

18. The work roll of claim 1 wherein the thermal spray powder has a Co particle size of from about 0.1 to about 10 microns.

19. The work roll of claim 1 wherein MC is a major phase and $M_2C$ a minor phase.

20. The work roll of claim 1 wherein WC is a major phase and $W_2C$ a minor phase.

21. A work roll for use in metal or metal alloy sheet manufacture comprising a cylindrical-like structure having an outer peripheral surface and a thermally sprayed coating on the outer peripheral surface of said cylindrical-like structure, wherein said thermally sprayed coating is thermal sprayed from a thermal spray powder, said thermally sprayed coating comprising (i) one or more metal carbides represented by the formula $M_xC$ wherein M is one or more of W, Co, Mo and Cr, (ii) a metallic binder comprising Co, Cr, Mn, Fe, and/or Ni, and (iii) a $Cr_2O_3$ layer in at least a portion of splat boundaries to protect said metal carbides and said metallic binder; wherein said thermal spray powder has a particle size from about 5 to about 50 microns and a metal carbide grain size of from about 0.1 to about 2 microns; and wherein said thermally sprayed coating has a surface roughness less than about 60 microinches Ra; wherein $M_xC$ comprises one or more of MC, $M_2C$ $M_6C$, $M_9C$ and $M_{12}C$ phases; and wherein said thermally sprayed coating has a porosity of not greater than about 2.5%.

22. The work roll of claim 21 wherein said thermal spray powder has a metal carbide grain size of from about 0.5 to about 1 micron.

23. The work roll of claim 21 wherein the thermal spray powder has a Co particle size of from about 0.1 to about 10 microns.

24. The work roll of claim 21 wherein MC is a major phase and $M_2C$ a minor phase.

25. The work roll of claim 21 wherein WC is a major phase and $W_2C$ a minor phase.

26. A work roll for use in metal or metal alloy sheet manufacture comprising a cylindrical-like structure having an outer peripheral surface and a thermally sprayed coating on the outer peripheral surface of said cylindrical-like structure, wherein said thermally sprayed coating is thermal sprayed from a thermal spray powder, said thermally sprayed coating comprising (i) one or more metal carbides represented by the formula $M_xC$ wherein M is one or more of W, Co, Mo and Cr, (ii) a metallic binder comprising Co, Cr, Mn, Fe, and/or Ni, and (iii) a $Cr_2O_3$ layer in at least a portion of splat boundaries to protect said metal carbides and said metallic binder; wherein said thermal spray powder has a particle size from about 5 to about 50 microns, a cobalt particle size of from about 0.1 to about 10 microns, and a metal carbide grain size of from about 0.1 to about 2 microns; and wherein said thermally sprayed coating has a surface roughness less than about 60 microinches Ra; wherein $M_x$comprises one or more of MC, $M_2C$, $M_6C$, $M_9C$ and $M_{12}C$ phases; and wherein said thermally sprayed coating has a porosity of not greater than about 2.5%.

27. The work roll of claim 26 wherein MC is a major phase and $M_2C$ a minor phase.

28. The work roll of claim 26 wherein WC is a major phase and $W_2C$ a minor phase.

29. A work roll for use in metal or metal alloy sheet manufacture, said work roll comprising a cylindrical-like structure having an outer peripheral surface and a thermally sprayed coating on the outer peripheral surface of said cylindrical-like structure, wherein said thermally sprayed coating is thermal sprayed from a thermal spray powder, said thermally sprayed coating comprising from about 65 to about 95 weight percent of one or more metal carbides represented by the formula $M_xC$ wherein M is one or more of W, Co, Mo and Cr, and from about 5 to about 35 weight percent of one or more transition metals selected from chromium, manganese, iron, cobalt and nickel; wherein said thermal spray powder has a particle size from about 5 to about 50 microns and a Group VI metal carbide grain size of from about 0.1 to about 5 microns; wherein said thermally sprayed coating has a surface roughness less than about 60 microinches Ra; wherein $M_xC$ comprises one or more of MC, $M_2C$, $M_6C$, $M_9C$ and $M_{12}C$ phases; wherein said thermally sprayed coating has a porosity of not greater than about 2.5%; and wherein said thermally sprayed coating increases the time required for reduction forces to wear said thermally sprayed coating and damage surface quality of the metal or metal alloy sheet.

30. The work roll of claim 29 wherein MC is a major phase and $M_2C$ a minor phase.

31. The work roll of claim 29 wherein WC is a major phase and $W_2C$ a minor phase.

32. A work roll for use in metal or metal alloy sheet manufacture comprising a cylindrical-like structure having an outer peripheral surface and a thermally sprayed coating on the outer peripheral surface of said cylindrical-like structure, wherein said thermally sprayed coating is thermal sprayed from a thermal spray powder, said thermally sprayed coating comprising (i) one or more metal carbides represented by the formula $M_xC$ wherein M is one or more of W, Co, Mo and Cr, (ii) a metallic binder comprising Co, Cr, Mn, Fe, and/or Ni, and (iii) a $Cr_2O_3$ layer in at least a portion of splat boundaries to protect said metal carbides and said metallic binder; wherein said thermal spray powder has a particle size from about 5 to about 50 microns and a metal carbide grain size of from about 0.1 to about 5 microns; wherein said thermally sprayed coating has a surface roughness less than about 60 microinches Ra; wherein $M_xC$ comprises one or more of MC, $M_2C$, $M_6C$, $M_9C$, and $M_{12}C$ phases; wherein said thermally sprayed coating has a porosity of not greater than about 2.5%; and wherein said thermally sprayed coating increases the time required for reduction forces to wear said thermally sprayed coating and damage surface quality of the metal or metal alloy sheet.

33. The work roll of claim 32 wherein MC is a major phase and $M_2C$ a minor phase.

34. The work roll of claim 32 wherein WC is a major phase and $W_2C$ a minor phase.

35. A work roll for use in metal or metal alloy sheet manufacture comprising a cylindrical-like structure having an outer peripheral surface and a thermally sprayed coating on the outer peripheral surface of said cylindrical-like structure, wherein said thermally sprayed coating is thermal sprayed from a thermal spray powder, said thermally sprayed coating comprising (i) one or more metal carbides represented by the formula $M_xC$ wherein M is one or more of W, Co, Mo and Cr, (ii) a metallic binder comprising Co, Cr, Mn, Fe, and/or Ni, and (iii) a $Cr_2O_3$ layer in at least a portion of splat boundaries to protect said metal carbides and said metallic binder; wherein said thermal spray powder has a particle size from about 5 to about 50 microns, a cobalt particle size of from about 0.1 to about 10 microns, and a metal carbide grain size of from about 0.1 to about 5 microns; wherein said thermally sprayed coating has a surface roughness less than about 60 microinches Ra; wherein $M_xC$ comprises one or more of MC, $M_2C$ $M_6C$ $M_9C$ and $M_{12}C$ phases; wherein said thermally sprayed coating has a porosity of not greater than about 2.5%; and wherein said thermally sprayed coating increases the time required for reduction forces to wear said thermally sprayed coating and damage surface quality of the metal or metal alloy sheet.

36. The work roll of claim 35 wherein MC is a major phase and $M_2C$ a minor phase.

37. The work roll of claim 35 wherein WC is a major phase and $W_2C$ a minor phase.

* * * * *